US005715615A

United States Patent [19]

Murakami et al.

[11] Patent Number: 5,715,615

[45] Date of Patent: Feb. 10, 1998

[54] HYDRAULIC WORKING MACHINE

[75] Inventors: Yoshiaki Murakami; Isao Miyachi, both of Hiroshima; Takumi Sobajima, Ogaki, all of Japan

[73] Assignee: Kabushiki Kaisha Kobe Seiko Sho, Kobe, Japan

[21] Appl. No.: 645,758

[22] Filed: May 14, 1996

[30] Foreign Application Priority Data

May 16, 1995 [JP] Japan ..... 7-117454

[51] Int. Cl.[6] ..... B62D 25/24

[52] U.S. Cl. ..... 37/379; 296/37.1; 180/69.21

[58] Field of Search ..... 37/379, 380; 180/69.2, 180/69.21; 296/37.1, 190, 63; 460/118, 119; 56/15.7, 15.8

[56] References Cited

U.S. PATENT DOCUMENTS

| | | | |
|---|---|---|---|
| 3,841,430 | 10/1974 | Babbih Jr. et al. | 180/89 A |
| 4,062,582 | 12/1977 | Youmans | 296/28 U |
| 4,616,872 | 10/1986 | Akira et al. | 296/190 |
| 5,192,108 | 3/1993 | Richardson et al. | 296/37.1 |
| 5,303,792 | 4/1994 | Shimizu | 180/89.17 X |
| 5,465,803 | 11/1995 | Kirchen et al. | 180/69.21 |
| 5,481,857 | 1/1996 | Umemoto et al. | 56/15.8 X |

FOREIGN PATENT DOCUMENTS

| | | |
|---|---|---|
| 0 311 082 A1 | 4/1989 | European Pat. Off. . |
| 0 383 276 A1 | 8/1990 | European Pat. Off. . |
| 0 496 886 A1 | 8/1992 | European Pat. Off. . |
| 2-145575 | 12/1990 | Japan . |
| 5-125744 | 5/1993 | Japan . |
| 5-311698 | 11/1993 | Japan . |
| 6-272279 | 9/1994 | Japan . |
| 6-272280 | 9/1994 | Japan . |
| 6-87169 | 12/1994 | Japan . |
| 7-197488 | 8/1995 | Japan . |
| 2 024 113 | 1/1980 | United Kingdom . |

*Primary Examiner*—Terry Lee Melius
*Assistant Examiner*—Robert Pezzuto
*Attorney, Agent, or Firm*—Oblon, Spivak, McClelland, Maier & Neustadt, P.C.

[57] ABSTRACT

A hydraulic working machine includes a bonnet assembly extending along a rear end and opposite sides of a cab on a revolving upper structure so as to cover an internal combustion engine, a cooling fan, a radiator, and a hydraulic pump. The bonnet assembly is composed of first to three bonnets. The first bonnet and the second bonnet each cover an upper portion and a side portion of the internal combustion engine. The third bonnet covers a hydraulic oil tank and a fuel tank for the internal combustion engine. The first bonnet can be opened and closed in the horizontal direction and hence makes no contact or interference with a seat in the cab. The horizontally openable first bonnet is disposed above a counterweight and hence does never interfere with the counterweight. With the bonnet assembly thus arranged, the components mounted in the upper structure can be readily exposed in condition ready to maintain without involving dismounting of the seat even when the revolving upper structure is small in size.

20 Claims, 5 Drawing Sheets

HYDRAULIC WORKING MACHINE

BACKGROUND OF THE INVENTION

1. Field of the Invention

The present invention relates to a hydraulic working machine such as a hydraulic excavator.

2. Description of the Related Art

Hydraulic working machines such as hydraulic excavators are known, which includes a revolving upper structure mounted on a mobile lower structure or undercarriage such that the upper structure is substantially received within a circle having a diameter equal to the width of the undercarriage, and a rear portion of the upper structure does never project from the undercarriage while the upper structure is rotating. The hydraulic word-it machines of the type described are able to achieve a desired operation without difficulty as long as the working site is greater than the width of the undercarriage.

To enable operation in a limited or narrow working area or place, a small-sized hydraulic machine has been proposed, in which the width of the machine is further reduced while the aforesaid revolving performance taken within the width of the machine is maintained. As the width of the machine, decreases, the overall size of the upper structure should be reduced to insure rotation of the upper structure within the width the machine.

On the other hand in order to maintain a comfortable working condition or environment of an operator, a driver's cab mounted on the upper structure should preferably be placed outside the object of downsizing.

Under these circumstances, the cab occupies a relative large space on the small-sized revolving upper structure, limiting or narrowing an internal space of the upper structure which is available for mounting various components. Consequently, the components mounted in the upper structure are closely arranged with one another. For instance, an internal combustion engine is mounted in a rear portion of the upper structure, and a seat in the cab is located directly above a portion of the engine, and extending right over a rear bonnet.

In the small-sized hydraulic working machine of the foregoing construction, in the case that the rear bonnet has a structure openable upwardly, it cannot be frilly opened due to interference with the rear bonnet In the case of a "closed" or cabin type cab profiled to conform to the shape of the seat, the movement of the rear bonnet in the upward bonnet-opening direction is also inhibited due to interference with a rear end of the cabin projecting right over the rear bonnet.

Accordingly, when the maintenance of the internal combustion engine of the small-sized hydraulic working machine is necessary, the cab should be dismounted from the upper structure through a tedious and time-consuming manual dismounting operation.

In order to obviate the need for the cab dismounting operation, a modified small-sized hydraulic working machine has been proposed, which has an openable small window formed in a sidewall of the rear bonnet to provide an access to the internal combustion engine when the maintenance is necessary.

However, since the small window can only provide a limited open area in front of a part of the internal combustion engine, the maintenance of other components is difficult to achieve,

SUMMARY OF THE INVENTION

It is accordingly an object of the present invention to provide a hydraulic working machine having an improved maintainability and incorporating structural features by means of which various components mounted within a bonnet assembly can be readily exposed in condition ready to maintain without involving tedious and time-consuming dismounting of a seat in a cab even when the revolving upper structure is small in size.

According to a preferred embodiment of the present invention, there is provided a hydraulic working machine which comprises: an undercarriage; a revolving upper structure rotatably mounted on the undercarriage and having an internal combustion engine mounted therein; a cab disposed on one side of the revolving upper structure and including a seat; and a first bonnet provided on the revolving upper structure at a position in the rear of the seat and covering both an upper portion and a side portion of the internal combustion engine, the first bonnet being openable in the horizontal direction.

It is preferable that a second bonnet is disposed adjacent to the first bonnet and covers a portion of the internal combustion engine. The second bonnet is preferably arranged to cover both an upper part and a side part of said portion of the internal combustion engine. It is further possible to arrange the second bonnet to cover a cooling fan and a radiator that are provided on the internal combustion engine.

In another preferred form, the hydraulic working machine further includes a third bonnet covering a hydraulic oil tank and a fuel tank for the internal combustion engine that are mounted in the revolving upper structure adjacent to a side which is opposite to said one side.

The first bonnet, which covers an upper portion and a side portion of the internal combustion engine, is openable in the horizontal direction and, hence, it makes no contact or interference with a seat overhanging the first bonnet. With the first bonnet thus arranged, a relatively large area extending over the internal combustion engine and other components can be exposed even in the presence of the seat.

In the case where the first bonnet is used in combination with the second bonnet, it is possible to selectively open the first and second bonnets and hence open the corresponding part of the upper structure according to the need for maintenance.

It is further possible according to the present invention to provide a counterweight on the upper structure in such a condition that the counterweight is disposed below the bonnets and normally held in contact with the bonnets. With this arrangement, when the bonnet are open, the internal combustion engine is accessible not only from the above but also from opposite sides. The maintenance of the engine can, therefore, be achieved with improved efficiency.

The above and other object features and advantages of the present invention will become manifest to those versed in the art upon making reference to the detailed description and accompanying sheets of drawings in which preferred structural embodiments incorporating the principles of the present invention are shown by way of illustrative example.

DESCRIPTION OF THE PREFERRED EMBODIMENTS

Certain preferred structural embodiments of the present invention will be described below in greater detail with reference to the accompanying sheets of drawings.

Figure 1:
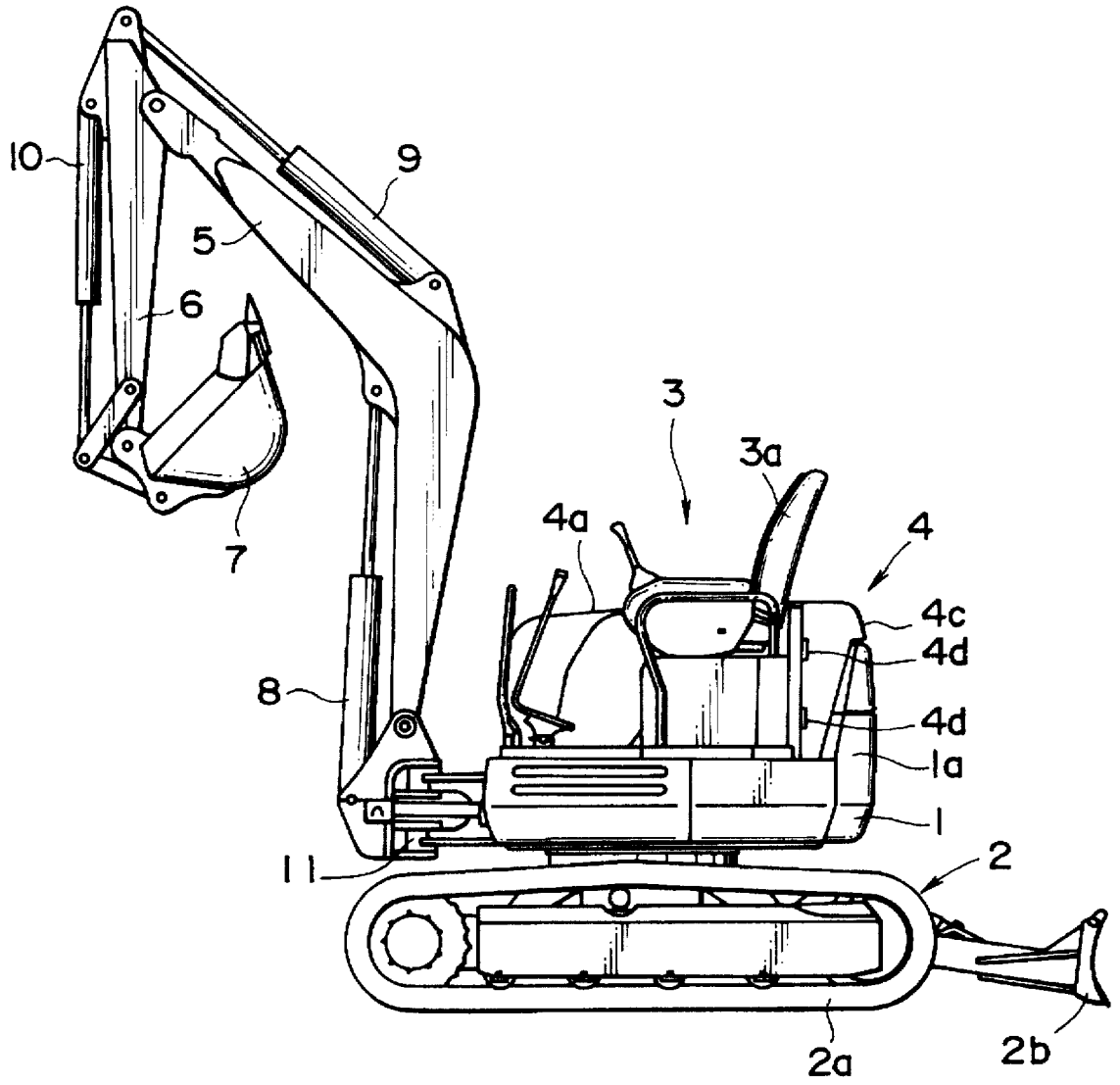
FIG. 1 is a side view of a hydraulic excavator according to one embodiment of the present invention.
Figure 2:
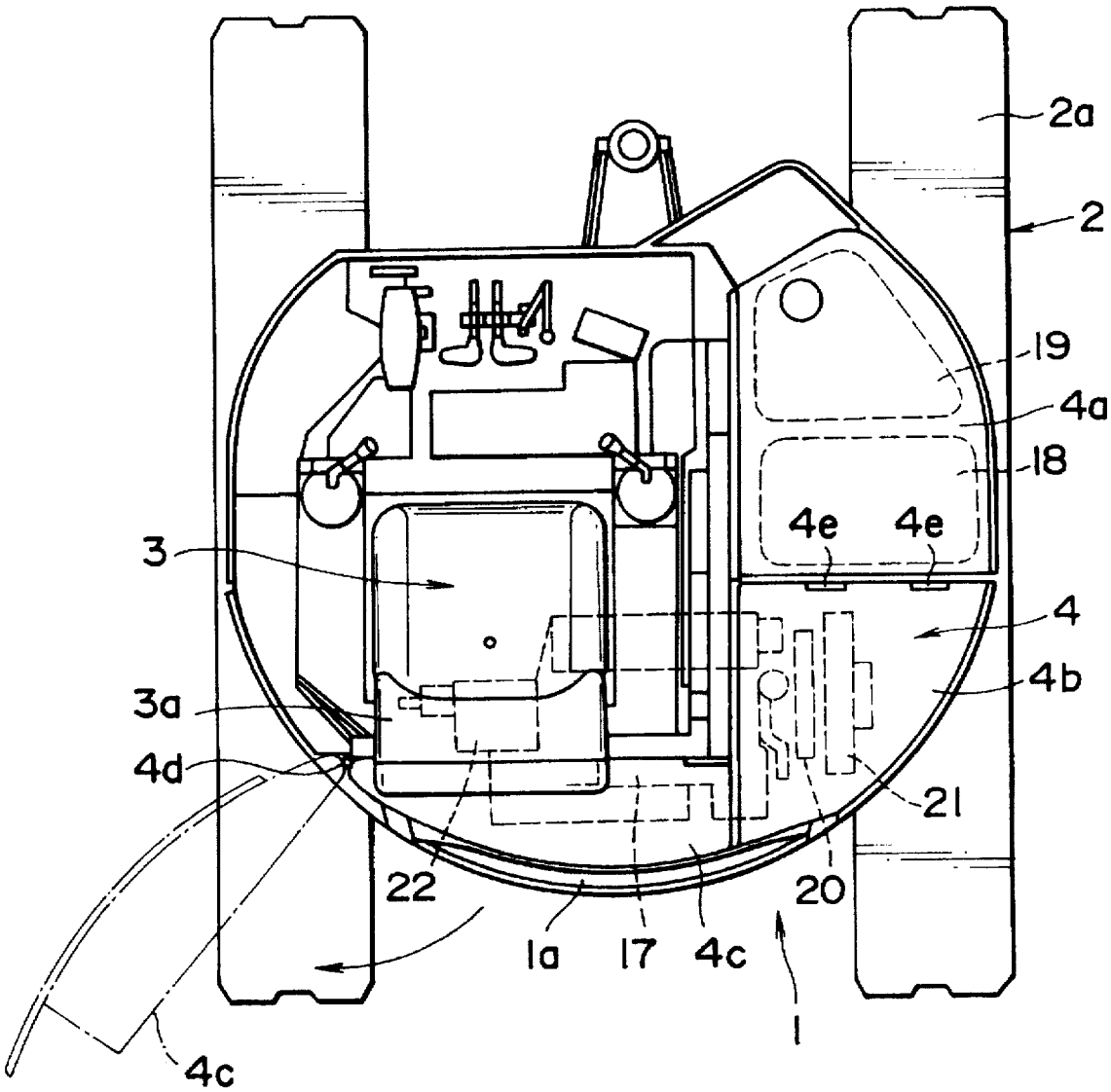
FIG. 2 is a diagrammatical plan view of a revolving upper structure of the hydraulic working machine shown in FIG. 1.

FIGS. 1 and 2 show a hydraulic working machine according to the present invention which is composed of a small-sized hydraulic excavator designed for use in a limited or narrow working area. The small-sized hydraulic excavator includes a revolving upper structure 1 rotatably mounted on a mobile lower structure or undercarriage 2. The revolving upper structure 1 has a driver's cab 3 (operating portion) provided on the left side of a front portion of the upper structure 1. The revolving upper structure 1 further includes a bonnet assembly 4 so constructed as to surround a right side and a rear side of a lower portion of the cab 3 and contain various apparatus described later on.

As shown in FIG. 1, the revolving upper structure 1 further includes a boom 5, an arm 6, and a bucket 7 projecting from the front end of the upper structure 1 in the order named. The boom 5, the arm 6 and the bucket 7 are pivotally movable in a vertical plane by means of a boom hydraulic cylinder 8, an arm hydraulic cylinder 9, and a bucket hydraulic cylinder 10, respectively. The boom 5 is pivotally mounted on a vertical post 11 disposed on the front end of the revolving upper structure 1 so that the boom 5 can swing or revolve about the vertical post 11 in the leftward and rightward directions of the upper structure 1. The undercarriage 2 has a crawler 2*a*, and a dozer 2*b*.

Figure 3:
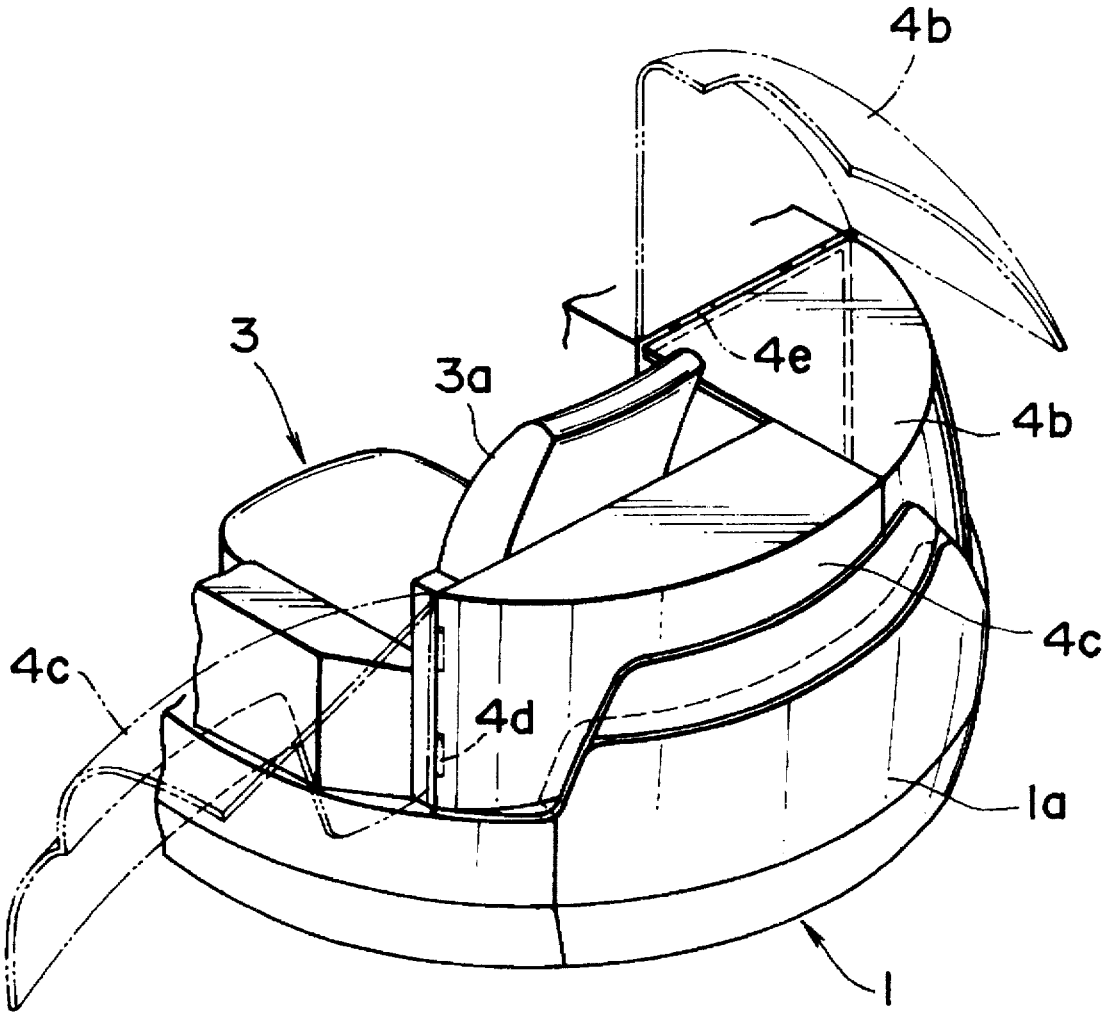
FIG. 3 is a perspective view illustrating a rear portion of the hydraulic working machine shown in FIG. 1.

As shown in FIG. 2, the revolving upper structure 1 has a shape in the plan view which is substantially received within a circle having a diameter equal to the entire width of the machine or vehicle. More particularly, a rear half of the bonnet assembly 4 has a shape completely received within the same circle, Accordingly, the rear half of the bonnet assembly 4 does never project from the overall width of the machine while the upper structure 1 is rotating. A counterweight 1*a* (see. FIG. 3) is integrally connected to the rear end of the revolving upper structure 1. The counterweight 1*a* has a convex shape swelling out from the rear end of the upper structure 1.

The bonnet assembly 4 of the revolving upper structure 1 has an internal space in which are mounted various apparatus including an internal combustion engine 17, a hydraulic oil tank 18, and a fuel rank 19 for the internal combustion engine 17.

The internal combustion engine 17 is mounted in the revolving upper structure 1 at a position located rearward of the cab 3. The internal combustion engine 17 is arranged transversely of the revolving upper structure 1 with its crankshaft (not shown) aligned with the transverse direction (widthwise or lateral direction) of the revolving upper structure 1. The internal combustion engine 17 is provided with a cooling fan 20 and a radiator 21 that are disposed on the right side of the engine 17, and also with a hydraulic pump 22 which is disposed on the left side of the engine 17 and driven by the engine 17. The fuel tank 19 and the hydraulic oil tank 18 are mounted in series in the longitudinal direction of the revolving upper structure 1, with the fuel tank 19 located forwards of the hydraulic oil tank 18.

The bonnet assembly 4, as shown in FIG. 2, is composed of a third bonnet 4*a* covering the hydraulic oil tank 18 and the fuel tank 19, a second bonnet 4*b* disposed adjacent to a rear end of the third bonnet 4*a* and covering the radiator 21 and the cooling fan 20 of the internal combustion engine 17, and a first bonnet 4*c* disposed in the rear of the cab 3 and covering the internal combustion engine 17 and the hydraulic pump 22.

The first bonnet 4*c* disposed in the rear of the cab 3 can be opened and closed in the horizontal direction by means of a hinge 4*d* which is disposed at one side of the cab 3 and has a pivot axis arranged vertically. When the first bonnet 4*c* is opened, the internal combustion engine 17 and the hydraulic pump 22 are exposed.

The second bonnet 4*b* disposed in the rear of the hydraulic oil tank 18 and the fuel tank 19 for the internal combustion engine 17 can be opened and closed in the vertical direction by means of a hinge 4*e* which is disposed on the other side of the cab 3 and has a pivot axis arranged horizontally. When the second bonnet 4*b* is opened, the cooling fan 20 and the radiator 21 are exposed.

As shown in FIG. 3, the first bonnet 4*c* is openable in the horizontal direction by means of the hinge 4*d*. The first bonnet 4*c* can, therefore, be readily opened and closed without interference with the seat 3*a* even though the seat 3*a* in the cab 3 of the illustrated small-sized hydraulic excavator has a seat back overhanging the first bonnet 4*c* (see FIG. 1). As a consequence of the smooth opening and closing operation of the first hinge 4*c*, the internal combustion engine 17 and the hydraulic pump 22 can be exposed in condition ready to maintain. Similarly, when the second bonnet 4*b* is opened, the cooling fan 20 and the radiator 21 of the internal combustion engine 17 are exposed in condition ready to maintain.

In despite of the presence of the counterweight 1*a* at the rear end of the revolving upper structure 1, the first and second bonnets 4*b* and 4*c*, when they are opened, provide a large space around the counterweight 1*a*. Accordingly, the maintenance of the components specified above can be achieved with ease.

The second bonnet 4*b* and the first bonnet 4*c*, as indicated by phantom lines shown in FIG. 3, have respective lower edges engageable with an upper edge and opposite side edges of the counterweight 1*a*. Accordingly, when these bonnets 4*b*, 4*c* are closed, the above-specified components mounted in the rear portion of the revolving upper structure 1 are concealed by the second and first bonnets 4*b*, 4*c* and the counterweight 1*a*.

Figure 4:
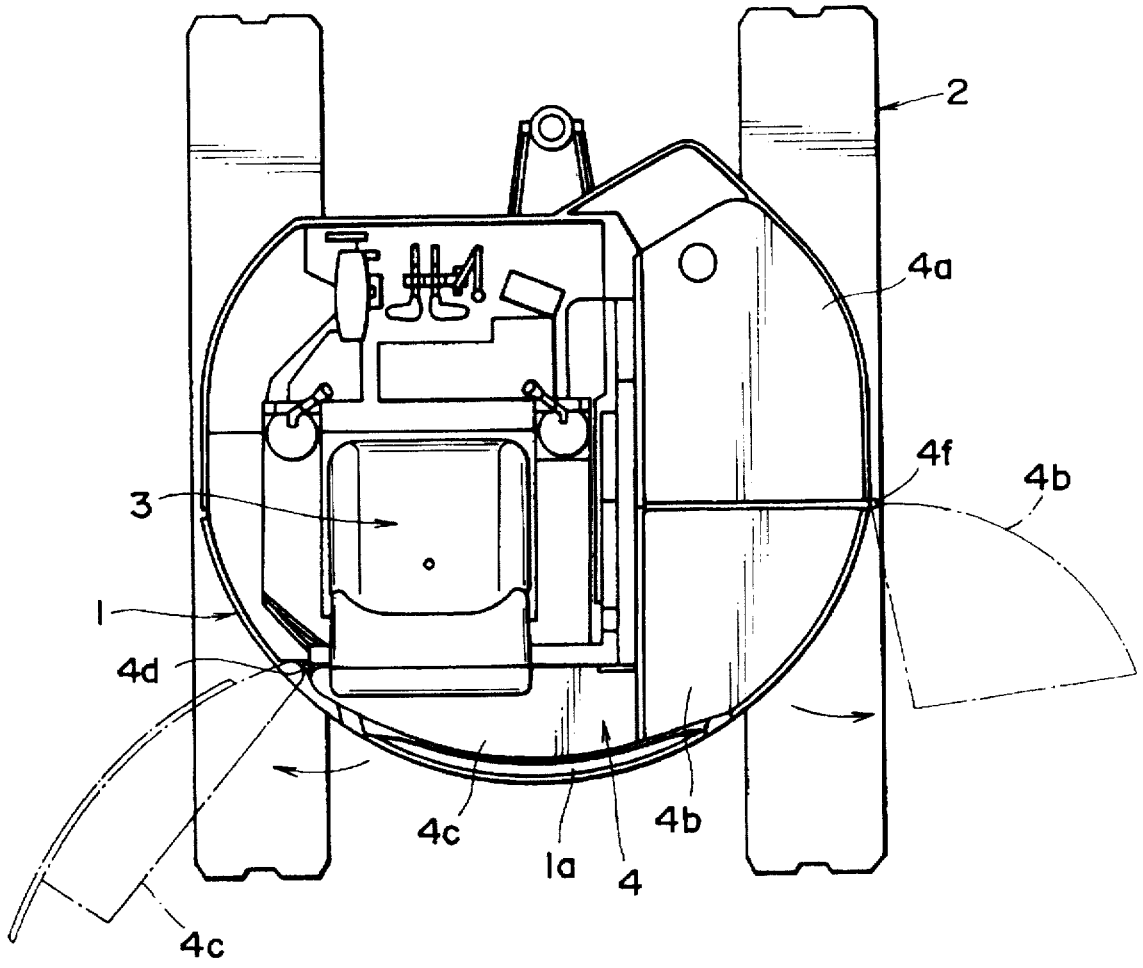
FIG. 4 is a diagrammatical plan view of the revolving upper structure including a bonnet assembly according to another embodiment of the present invention.

The second bonnet 4*b* which is openable in the vertical direction can be modified into a horizontally openable bonnet, such as shown in FIG. 4. In the latter case, the horizontally openable second bonnet 4*b* has a hinge 4*f* which is disposed on the other side of the seat 3*a* and has a pivot axis arranged vertically.

Figure 5:
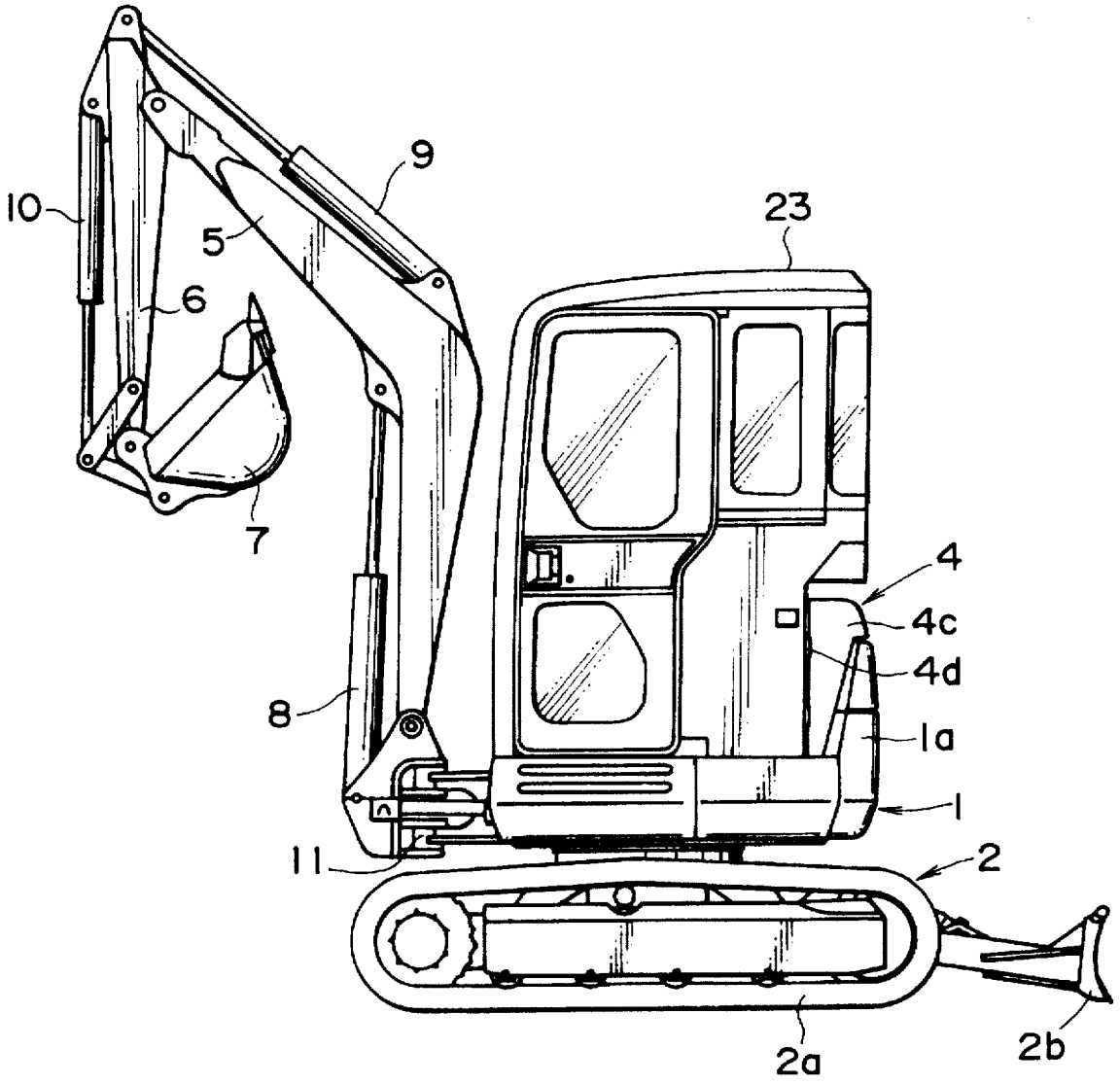
FIG. 5 is an explanatory side view showing still another embodiment of the present invention.

The hydraulic excavator of the embodiments described above has a cab 3 having an exposed seat 3*b*. It is possible according to another embodiment of the present invention to employ a closed cabin 23 (operating portion) enclosing the seat 3*a*, as shown in FIG. 5. The cabin 23 is profiled such that a rear wall of the cabin 23 overhangs the first bonnet 4*c* in agreement with the shape of the seat 3*a*. Since the first bonnet 4*c* is openable in the horizontal direction (toward the face side on the drawing sheet of FIG. 5), it makes no contract or interference with the cabin 23. The internal combustion engine 17 and the hydraulic pump 22 can, therefore, be smoothly placed in the exposed condition which is ready to maintain.

It appears clear from the foregoing description that since the first bonnet disposed in the rear of the cab is openable in the horizontal direction, this bonnet can be opened with no interference with the seat in the cab. Accordingly, the maintenance of the internal combustion entwine and the hydraulic pump can be achieved in the presence of the seat in the cab. In addition, since the second bonnet disposed adjacent to the rear end of the third bonnet is openable either in the horizontal direction or in the vertical direction, the rear portion of the revolving upper structure is opened over a relatively large area when the second and first bonnet are open. Thus, the maintenance of the components disposed in the thus opened rear portion of the upper structure can be achieved smoothly and reliably. The second and first bonnets are movable independently from each other and hence can be opened selectively to open the corresponding part of the upper structure according to the need for maintenance. With this arrangement, the maintenance is achievable with improved efficiently.

According to one preferred embodiment of the invention, the cab may be equipped with a cabin in which instance, however, since the first bonnet has a horizontally openable structure, the rear end portion of the revolving upper structure can be opened in condition ready to maintain without being influence by the presence of the cabin.

In another preferred form of the invention, the counterweight is attached to the rear end of the revolving upper structure at a position laterally spaded from the side edge of the cab and the side edge of the third bonnet, and the second and first bonnets cover the rear end of the revolving upper structure with their lower edges held in contact with an upper edge and opposite side edges of the counterweight. Accordingly, when the second and first bonnets are opened, upper and side boundary areas of the counterweight are widely opened. Under such condition, the maintenance of the components mounted in the rear end portion of the revolving upper structure can be achieved with utmost ease.

Obviously, various minor changes and modifications of the present invention are possible in the light of the above teaching. It is therefore to be understood that within the scope of the appended claims the invention may be practiced otherwise than as specifically described.

What is claimed is:

1. A hydraulic working machine comprising:

an undercarriage;

a revolving upper structure rotatably mounted on said undercarriage in a substantially horizontal direction, said upper structure having a front end thereof and an internal combustion engine mounted therein;

an operating portion disposed on one side of said revolving upper structure and including a seat facing the front end;

a first bonnet provided on said revolving upper structure at a position overhung by a back of said seat and in the rear of said seat and covering both an upper portion and two side portions of said internal combustion engine, said first bonnet being openable in the horizontal direction; and a second bonnet disposed adjacent said first bonnet and covering a portion of said internal combustion engine.

2. A hydraulic working machine according to claim 1, further including a counterweight disposed below said first bonnet and held in contact with said first bonnet when said first bonnet is closed.

3. A hydraulic working machine according to claim 1, wherein said second bonnet is openable in a vertical direction about an axis disposed on a side of said upper structure opposite said first bonnet.

4. A hydraulic working machine according to claim 1, further including a counterweight disposed below said first and second bonnets.

5. A hydraulic working machine according to claim 1, wherein said first bonnet has a first longitudinal axis, said second bonnet having a second longitudinal axis, said first longitudinal axis of said first bonnet and said second longitudinal axis of said second bonnet being perpendicular to each other.

6. A hydraulic working machine according to claim 1, wherein said second bonnet covers an upper part and a side part of said internal combustion engine.

7. A hydraulic working machine according to claim 1, wherein said internal combustion engine is equipped with a cooling fan and a radiator, said second bonnet covering said cooling fan and said radiator.

8. A hydraulic working machine according to claim 1, further including a third bonnet covering a hydraulic oil tank and a fuel tank for said internal combustion engine that are mounted in said revolving upper structure.

9. A hydraulic working machine according to claim 1, further including a third bonnet covering a hydraulic oil tank and a fuel tank for said internal combustion engine that are mounted in said revolving upper structure adjacent to a side.

10. A hydraulic working machine according to claim 1, further including a counterweight disposed below said first and second bonnets and held in contact with said first and second bonnets when said first and second bonnet are closed.

11. A hydraulic working machine according to claim 1, wherein said operating portion is a cabin containing said seat.

12. A hydraulic working machine comprising:

an undercarriage;

a revolving upper structure rotatably mounted on said undercarriage in a substantially horizontal direction, said upper structure having a front end thereof and an internal combustion engine mounted therein;

an operating portion disposed on one side of said revolving upper structure and including a seat facing the front end;

a first bonnet provided on said revolving upper structure at a position in the rear of said seat and covering both an upper portion and a side portion of said internal combustion engine, said first bonnet being openable in the horizontal direction; and an openable second bonnet disposed adjacent to said first bonnet and covering another portion of said internal combustion engine, wherein said first and second bonnets are arranged such that an upper surface of the internal combustion engine is made accessible by opening of said first and second bonnets.

13. The hydraulic working machine of claim 12 wherein said first and second bonnets are arranged such that upper, front and rear surfaces of the internal combustion engine are made accessible by opening of said first and second bonnets.

14. A hydraulic working machine according to claim 12, further including a counterweight disposed below said first bonnet and held in contact with said first bonnet when said first bonnet is closed.

15. A hydraulic working machine according to claim 12, wherein said second bonnet is openable in a vertical direction about an axis disposed on a side of said upper structure opposite said first bonnet.

16. A hydraulic working machine according to claim 12, further including a counterweight disposed below said first and second bonnets.

17. A hydraulic working machine according to claim 12, wherein said first bonnet has a first longitudinal axis, said second bonnet has a second longitudinal axis, said first longitudinal axis of said first bonnet and said second longitudinal axis of said second bonnet being perpendicular to one another.

18. A hydraulic working machine according to claim 12, wherein said internal combustion engine is equipped with a cooling fan and a radiator, said second bonnet covering said cooling fan and said radiator.

19. A hydraulic working machine according to claim 12, further including a third bonnet covering a hydraulic oil tank and a fuel tank for said internal combustion engine, the hydraulic oil tank and the fuel tank being mounted in said revolving upper structure.

20. A hydraulic working machine according to claim 12, wherein said operating portion is a cabin containing said seat.

* * * * *